US012108829B2

(12) United States Patent
Chambers et al.

(10) Patent No.: US 12,108,829 B2
(45) **Date of Patent: *Oct. 8, 2024**

(54) SOLE STRUCTURE FOR AN ARTICLE OF FOOTWEAR WITH UNDULATING SOLE PLATE

(71) Applicant: NIKE, Inc., Beaverton, OR (US)

(72) Inventors: Clayton Chambers, Portland, OR (US); John Droege, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/331,258

(22) Filed: Jun. 8, 2023

(65) Prior Publication Data

US 2023/0309651 A1 Oct. 5, 2023

Related U.S. Application Data

(63) Continuation of application No. 17/567,210, filed on Jan. 3, 2022, now Pat. No. 11,717,050, which is a continuation of application No. 16/842,005, filed on Apr. 7, 2020, now Pat. No. 11,246,374, which is a continuation of application No. 15/983,566, filed on May 18, 2018, now Pat. No. 10,631,591.

(60) Provisional application No. 62/509,824, filed on May 23, 2017.

(51) Int. Cl.

| | |
|---|---|
| ***A43B 13/18*** | (2006.01) |
| ***A43B 3/00*** | (2022.01) |
| ***A43B 5/00*** | (2022.01) |
| ***A43B 13/02*** | (2022.01) |
| ***A43B 13/04*** | (2006.01) |
| ***A43B 13/08*** | (2006.01) |
| ***A43B 13/10*** | (2006.01) |
| ***A43B 13/12*** | (2006.01) |
| ***A43B 13/14*** | (2006.01) |

(52) U.S. Cl.

CPC ..... *A43B 13/141* (2013.01); *A43B 3/0057* (2013.01); *A43B 5/00* (2013.01); *A43B 13/026* (2013.01); *A43B 13/04* (2013.01); *A43B 13/08* (2013.01); *A43B 13/10* (2013.01); *A43B 13/125* (2013.01); *A43B 13/181* (2013.01); *A43B 13/186* (2013.01); *A43B 13/188* (2013.01)

(58) Field of Classification Search

CPC ..... A43B 13/00; A43B 13/026; A43B 13/10; A43B 13/12; A43B 13/18; A43B 13/181

USPC ..... 36/25 R, 28, 30 R

See application file for complete search history.

(56) References Cited

U.S. PATENT DOCUMENTS 1,527,371 A * 2/1925 Mullarky ..... A43B 7/06 36/3 R 2,124,819 A * 7/1938 Halloran ..... A43B 13/42 36/76 R (Continued)

*Primary Examiner* — Marie D Bays

(74) *Attorney, Agent, or Firm* — Quinn IP Law

(57) ABSTRACT

A sole structure for an article of footwear comprises a sole plate including a midfoot region and at least one of a forefoot region and a heel region. The sole plate has an undulating profile at a transverse cross-section of the sole plate. The undulating profile includes multiple waves each having a crest and a trough. The sole plate has ridges corresponding with the crest and the trough of each wave and extending longitudinally throughout the midfoot region and the at least one of a forefoot region and a heel region.

20 Claims, 10 Drawing Sheets

(56) References Cited

U.S. PATENT DOCUMENTS 2,713,732 A * 7/1955 Guest ..... A43B 7/14 36/167
4,561,195 A * 12/1985 Onoda ..... A43B 13/12 36/31
5,469,639 A * 11/1995 Sessa ..... A43B 13/181 36/28
5,720,118 A * 2/1998 Mayer ..... A43B 13/38 36/107
5,987,782 A * 11/1999 Bramani ..... A43B 13/10 36/31
6,023,861 A * 2/2000 Bizzotto ..... A43B 13/12 36/179
6,205,681 B1 * 3/2001 Kita ..... A43B 13/026 36/27
6,311,414 B1 * 11/2001 Kita ..... A43B 13/026 36/35 B
6,625,905 B2 * 9/2003 Kita ..... A43B 13/12 36/28
7,594,345 B2 * 9/2009 Fusco ..... A43B 13/223 36/103
7,886,460 B2 2/2011 Teteriatnikov et al.
8,479,414 B2 * 7/2013 Baker ..... A43B 7/148 36/43
10,631,591 B2 * 4/2020 Chambers ..... A43B 13/026
11,284,670 B2 * 3/2022 Iuchi ..... A43B 13/127
11,717,050 B2 * 8/2023 Chambers ..... A43B 13/181 36/28
2002/0184792 A1 * 12/2002 Sugawara ..... A43B 13/141 36/28
2010/0307028 A1 12/2010 Teteriatnikov et al.
2014/0331518 A1 * 11/2014 Mayer ..... A43B 13/183 36/28
2018/0168281 A1 6/2018 Case et al.

* cited by examiner

SOLE STRUCTURE FOR AN ARTICLE OF FOOTWEAR WITH UNDULATING SOLE PLATE

CROSS-REFERENCE TO RELATED APPLICATIONS

This application is a continuation of U.S. application Ser. No. 17/567,210, filed Jan. 3, 2022, which is a continuation of U.S. application Ser. No. 16/842,005, filed Apr. 7, 2020, now U.S. Pat. No. 11,246,374, issued Feb. 15, 2022, which is a continuation of U.S. application Ser. No. 15/983,566, filed May 18, 2018, now U.S. Pat. No. 10,631,591, issued Apr. 28, 2020, which claims the benefit of priority to U.S. Provisional Application No. 62/509,824 filed May 23, 2017, and each of which is hereby incorporated by reference in their entirety.

TECHNICAL FIELD

The present teachings generally include a sole plate for an article of footwear.

BACKGROUND

Footwear typically includes a sole structure configured to be located under a wearer's foot to space the foot away from the ground. The sole structure can be designed to provide a desired level of cushioning. Athletic footwear in particular may utilize polyurethane foam and/or other resilient materials in the sole structure to provide cushioning.

DESCRIPTION

Figure 1:
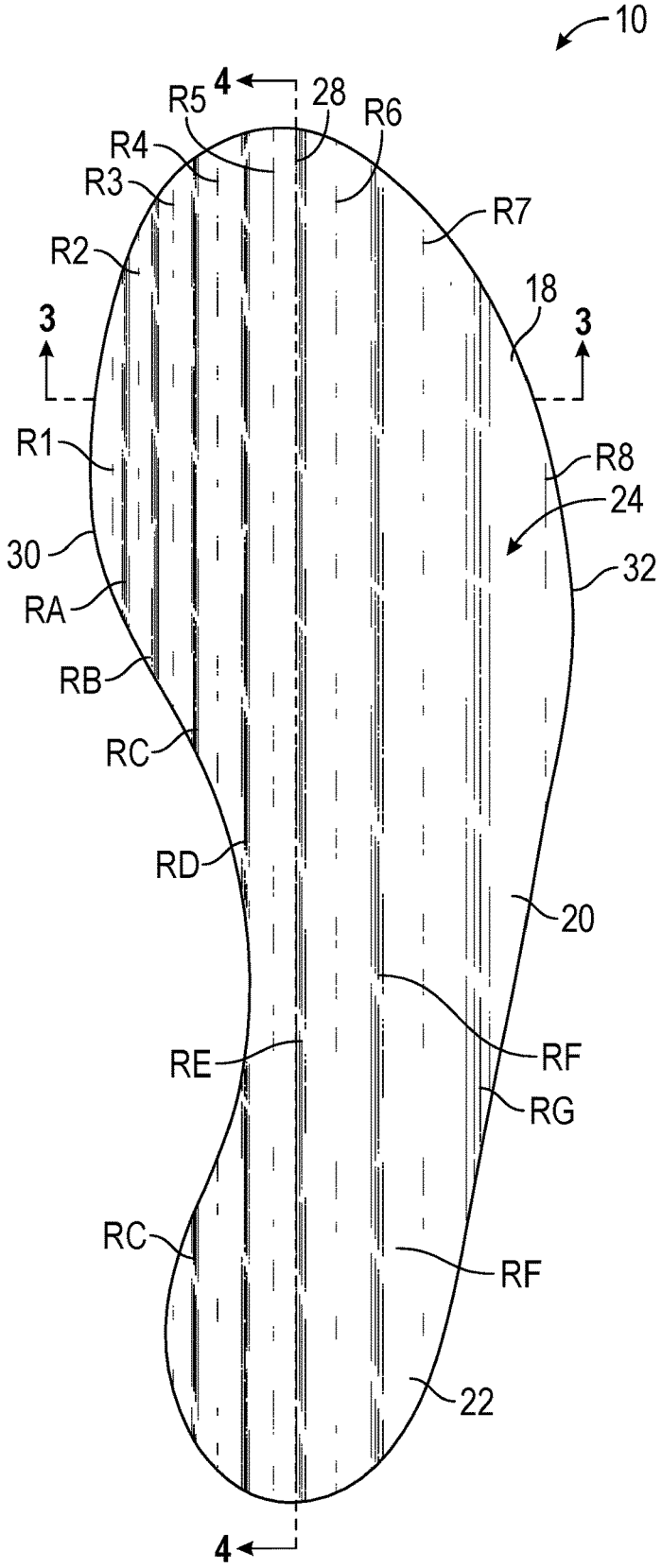
FIG. 1 is a schematic top view of an embodiment of a sole plate for an article of footwear.

A sole structure for an article of footwear comprises a sole plate including a midfoot region and at least one of a forefoot region and a heel region. The sole plate has an undulating profile at a transverse cross-section of the sole plate. The undulating profile includes multiple waves each having a crest and a trough. The sole plate has ridges corresponding with the crest and the trough of each wave and extending longitudinally throughout the midfoot region and the at least one of a forefoot region and a heel region. The ridges may be parallel with one another, and with a longitudinal midline of the sole plate in the midfoot region and the at least one of a forefoot region and a heel region.

In an embodiment, the sole plate is a resilient material such that each of the multiple waves decreases in elevation from a steady state elevation to a loaded elevation under a dynamic compressive load, and returns to the steady state elevation upon removal of the dynamic compressive load. For example, the sole plate may be a fiber strand-lain composite, a carbon-fiber composite, a thermoplastic elastomer, a glass-reinforced nylon, wood or steel.

In various embodiments, the undulating profile may extend from a medial extremity of the sole plate to a lateral extremity of the sole plate, and each of the multiple waves may have an amplitude at the crest, and a depth at the trough equal to the amplitude.

In some embodiments, the multiple waves may vary in wavelength. For example, the multiple waves may include at least two waves disposed between a longitudinal midline and a medial extremity of the sole plate, and at least two waves disposed between the longitudinal midline and a lateral extremity of the sole plate. The at least two waves disposed between the longitudinal midline and the medial extremity may have a shorter average wavelength than the at least two waves disposed between the longitudinal midline and the lateral extremity. Assuming all other dimensions are equal, the sole plate will have greater compressive stiffness at a wave having a shorter wavelength than at a wave having a longer wavelength.

In some embodiments, the sole plate includes both the forefoot region and the heel region (i.e., a full-length sole plate), and is a unitary, one-piece component. In an embodiment of a full-length sole plate, the sole plate slopes downward in the midfoot region from the heel region to the forefoot region. Due to the slope, the sole plate may have a flattened S-shape or a spoon shape at a longitudinal cross-section of the sole plate.

In an embodiment, the sole structure includes a foam midsole, and the sole plate is embedded in the foam midsole, with both a medial edge of the sole plate and a lateral edge of the sole plate encapsulated by the foam midsole.

A sole structure for an article of footwear may comprise a one-piece, unitary sole plate having a forefoot region, a midfoot region, and a heel region. The sole plate may have a corrugated top surface and a complementary corrugated bottom surface such that the sole plate comprises transverse waves with crests and troughs. The crests form ridges at the top surface and the troughs form ridges at the bottom surface. The ridges at the top surface and the ridges at the bottom surface extend longitudinally in at least two contiguous ones of the forefoot region, the midfoot region, and the heel region.

In an embodiment, the transverse waves include at least two waves disposed between a longitudinal midline and a medial extremity of the sole plate, and at least two waves disposed between the longitudinal midline and a lateral extremity of the sole plate. The at least two waves disposed between the longitudinal midline and the medial extremity have a shorter average wavelength than the at least two waves disposed between the longitudinal midline and the lateral extremity. At least some of the crests may be of equal amplitude and/or at least some of the troughs may be of equal depth. The sole plate may slope downward from the heel region to the forefoot region.

In an embodiment, the sole structure includes a foam midsole, and the sole plate is embedded in the foam midsole, with both a medial edge of the sole plate and a lateral edge of the sole plate encapsulated by the foam midsole.

In an embodiment, the sole plate is a resilient material such that the transverse waves decrease in elevation from a steady state elevation to a loaded elevation under a dynamic compressive load, and return to the steady state elevation upon removal of the dynamic compressive load. For example, the sole plate may be one of a fiber strand-lain composite, a carbon-fiber composite, a thermoplastic elastomer, a glass-reinforced nylon, wood, or steel.

The above features and advantages and other features and advantages of the present teachings are readily apparent from the following detailed description of the modes for carrying out the present teachings when taken in connection with the accompanying drawings.

Figure 6:
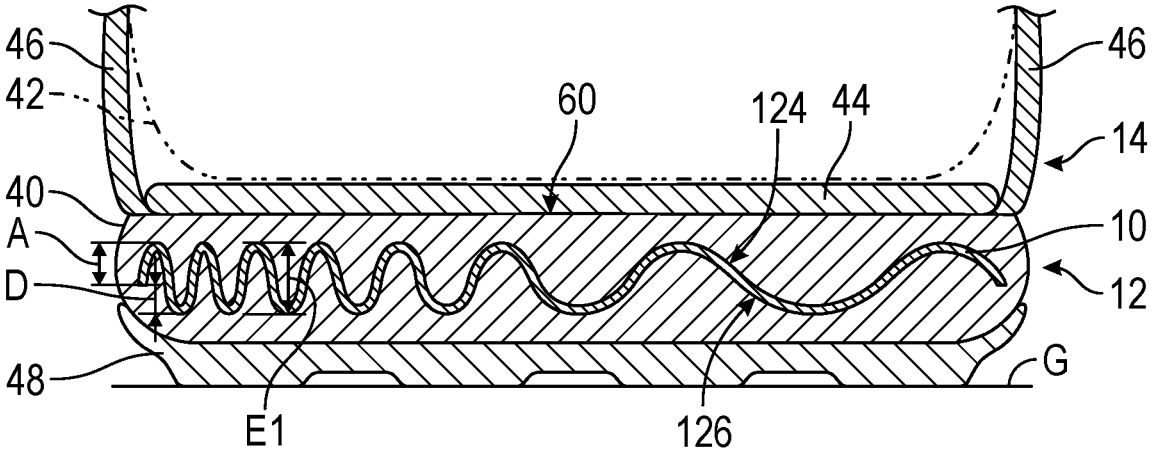
FIG. 6 is a schematic cross-sectional illustration of an article of footwear including a sole structure with the sole plate of FIG. 1 embedded in a midsole.

Referring to the drawings, wherein like reference numbers refer to like components throughout the several views, FIG. 1 shows a first embodiment of a sole plate 10 that can be included in a sole structure of an article of footwear, such as but not limited to the sole structure 12 of the article of footwear 14 shown in FIG. 6. As further explained herein, the sole plate 10 has multiple transverse waves that absorb dynamic loading by decreasing in elevation from a steady state elevation to a loaded elevation under a dynamic compressive load, and returning to the steady state elevation upon removal of the dynamic compressive load. The resiliency of the sole plate 10 contributes to a desirably high percentage energy return of the sole structure 12, i.e., the ratio of the energy released from the sole plate 10 in returning to its steady state elevation to the dynamic loading energy absorbed by the elastic deformation of the sole plate 10 in moving to its loaded elevation. The energy return may correlate with the height of the sole structure 12 after dynamic compressive loading is removed and the rate at which the sole structure 12 returns to the unloaded height.

In the embodiment shown, the sole plate 10 is a unitary, one-piece component that includes a forefoot region 18, a midfoot region 20, and a heel region 22. In other embodiments, within the scope of the present teachings, a sole plate with top and bottom surfaces and transverse waves similar to those of sole plate 10 may include only two contiguous ones of these regions, such as a midfoot region and at least one of a forefoot region and a heel region.

The sole plate 10 has a corrugated top surface 24 and a complementary corrugated bottom surface 26. The bottom surface 26 is considered "complementary" to the top surface 24 because the sole plate 10 has an undulating profile at a transverse cross-section taken anywhere through the sole plate 10 perpendicular to a longitudinal midline 28 of the sole plate 10. For example, at the transverse cross-section shown in FIG. 3, the undulating profile P1 includes multiple waves: wave W1, wave W2, wave W3, wave W4, wave W5, wave W6, wave W7, and a partial wave W8. A "wave" as discussed herein begins at a center axis 50 of the sole plate 10, rises to a crest above the center axis 50, falls to a trough below the center axis 50, and then rises back to and ends at the center axis 50. Wave W1 begins at a medial edge 30 of the sole plate 10 (also referred to herein as a medial extremity), and the partial wave W8 ends at a lateral edge 32 of the sole plate 10 (also referred to herein as a lateral extremity). Although the waves are shown as periodic, rounded waves, each generally following the shape of a sine wave, the waves could be squared or angular.

Each wave W1-W7 has a crest and a trough. For example, wave W1 has a crest C1 and a trough T1. Wave W2 has a crest C2 and a trough T2. Wave W3 has a crest C3 and a trough T3. Wave W4 has a crest C4 and a trough T4. Wave W5 has a crest C5 and a trough T5. Wave W6 has a crest C6 and a trough T6. Wave W7 has a crest C7 and a trough T7. Partial wave W8 has a crest C8. The crests C1-C8 are at the top surface 24, and the troughs T1-T7 are at the bottom surface 26.

Figure 2:
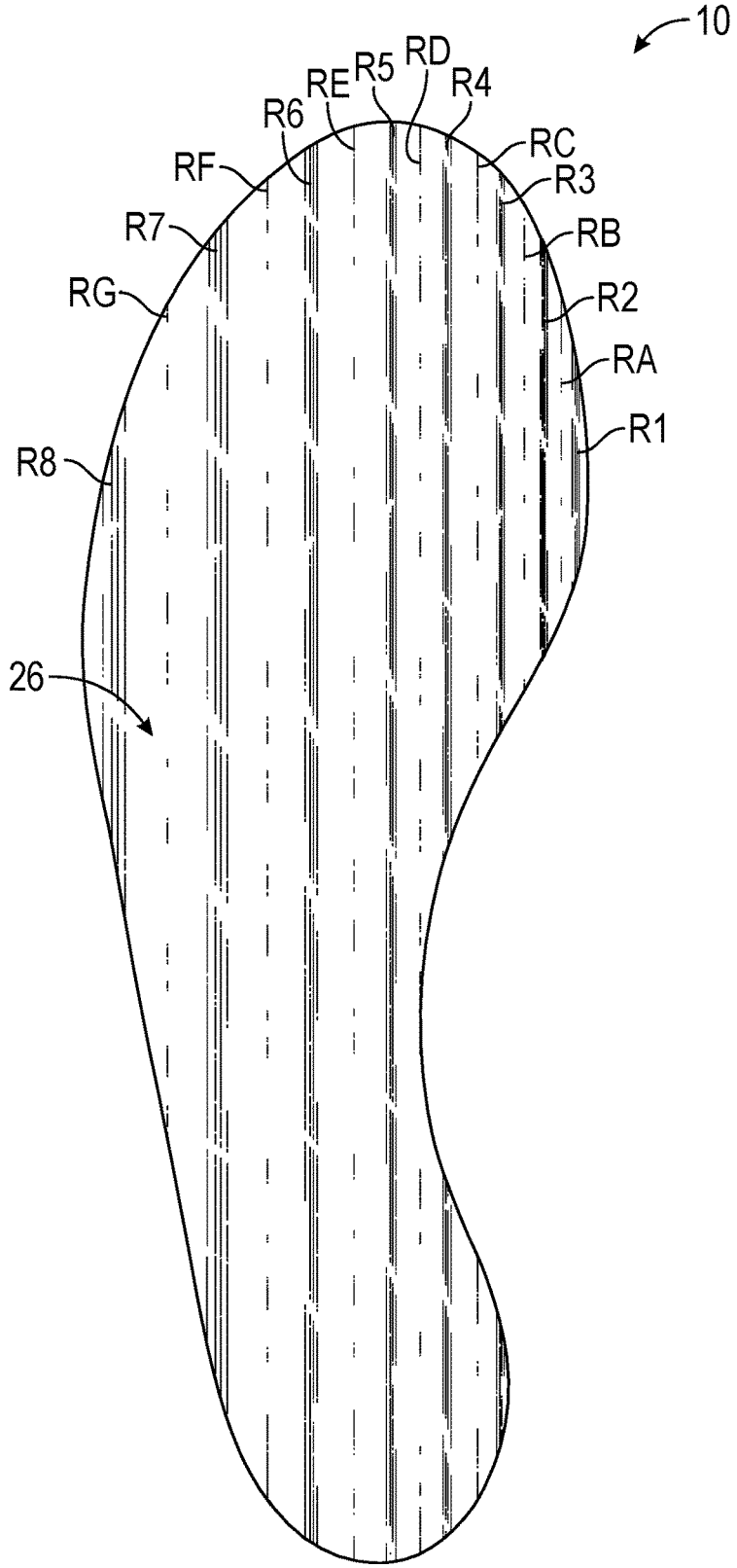
FIG. 2 is a schematic bottom view of the sole plate of FIG. 1.

Because the waves extend longitudinally, the crests form ridges R1, R2, R3, R4, R5, R6, R7, and R8 at the top surface 24 as shown in FIG. 1. The ridges R1, R2, R3, R4, R5, R6, R7, and R8 correspond with the crests C1, C2, C3, C4, C5, C6, C7, and C8, respectively. Because the waves extend longitudinally, the troughs forming ridges RA, RB, RC, RD, RE, RF, and RG at the bottom surface 26 (as shown in FIG. 2) corresponding with troughs T1, T2, T3, T4, T5, T6, and T7, respectively. The ridges R1, R2, R3, R4, R5, R6, R7, and R8 at the top surface 24, and the ridges RA, RB, RC, RD, RE, RF, and RG at the bottom surface 26 extend longitudinally and parallel to one another and to the longitudinal midline 28 in the forefoot region 18, the midfoot region 20, and the heel region 22. Depending on the shape of the outer perimeter of the sole plate 10 at the medial edge 30 and the lateral edge 32, individual ones of the ridges may extend in only one or two of the forefoot region, the midfoot region, or the heel region. For example, ridge R1, ridge R2, ridge RA, and ridge RB extend only on the forefoot region 18 due to the curvature of the medial edge 30. As a group, however, the ridges extend the entire length of the sole plate 10.

As shown in FIG. 6, the sole plate 10 can be embedded in a foam midsole 40 of the sole structure 12. The top surface 24, bottom surface 26, and the periphery, including both the medial edge 30 and the lateral edge 32 are encapsulated by the foam midsole 40. In the embodiments shown, the foam midsole 40 overlays and is in contact with the entire top surface 24, and underlies and is in contact with the entire bottom surface 26.

Figure 3:
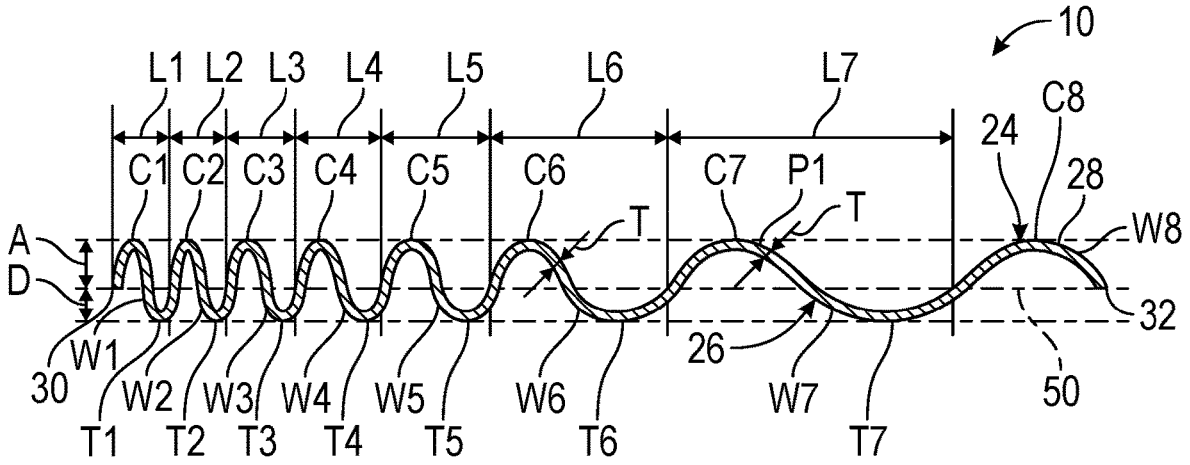
FIG. 3 is a schematic cross-sectional illustration of the sole plate of FIG. 1 taken at lines 3-3 in FIG. 1.

The sole plate 10 is a resilient material such as a fiber strand-lain composite, a carbon-fiber composite, a thermoplastic elastomer, a glass-reinforced nylon, wood, or steel. The resiliency of the sole plate 10 is such that when a dynamic compressive load is applied with at least a component of the force normal to the crests and the troughs (i.e., downward on the crests and with a reaction force upward on the troughs), the transverse waves will decrease in elevation from a steady state elevation to a loaded elevation, and will return to the steady state elevation upon removal of the dynamic compressive load. More specifically, as shown in FIGS. 3 and 6, each of the waves has a steady state elevation. The steady state elevation exists when the sole plate 10 is under a steady state load, or is unloaded. A steady state load is a load that remains constant, such as when a wearer of the article of footwear 14 is standing relatively still. In FIG. 6, the bottom extent of a wearer's foot 42 is shown in phantom supported on an insole 44 positioned on the midsole 40. An upper 46 is secured to the midsole 40 and surrounds the foot 42. An outsole 48 is secured to a lower extent of the midsole 40 such that it is positioned between the midsole 40 and the ground G, establishing a ground contact surface of the sole structure 12. Alternatively, the midsole 40 could be a unisole, in which case the midsole 40 would also at least partially serve as an outsole.

Referring again to FIG. 3, each of the multiple waves has an amplitude at its crest, and a depth at its trough. In the sole plate 10, each of the crests C1, C2, C3, C4, C5, C6, C7 and C8 has an equal amplitude A. Additionally, each of the troughs T1, T2, T3, T4, T5, T6, T7 has an equal depth D. In the embodiment shown, the amplitude A is equal to the depth D. "Equal" as used herein in regards to wavelength, elevation, amplitude, and depth refers to a range of magnitudes consistent with production tolerances of the sole plate 10, permitting some variation from absolute equality. For example, equal may refer to any value within 5 percent of a given value. The amplitude A of each crest is measured from a center axis 50 (i.e., the horizontal axis) of the sole plate 10 at the transverse cross section to the crest at the top surface 24. The depth D of each trough is measured from the center axis 50 of the sole plate 10 at the transverse cross section to the trough at the bottom surface 26.

In other embodiments, the amplitudes of the waves could vary, the depths of the waves could vary, or both could vary. For example, in one embodiment, the amplitudes of the crests could progressively decrease from the medial edge 30 to the lateral edge 32, and the depths of the troughs could progressively decrease from the medial edge 30 to the lateral edge 32.

In some embodiments, the wavelength of the waves can vary, and may do so in correspondence with expected loading. The sole plate 10, for example, has waves of a shorter average wave length disposed nearer the medial extremity 30 than the waves near the lateral extremity 32. Waves W1, W2, W3, W4, and a portion of wave W5 extend between the medial extremity 30 and the longitudinal midline 28 of the sole plate. Waves W6, W7 and the remaining portion of W5 extend between the longitudinal midline 28 and the lateral extremity 32 of the sole plate 10. The waves disposed between the longitudinal midline 28 and the medial extremity 30 have a shorter average wavelength than the waves disposed between the longitudinal midline 28 and the lateral extremity 32. Most specifically, as shown in FIG. 3, wave W1 has a wavelength L1, wave W2 has a wavelength L2, wave W3 has a wavelength L3, wave W4 has a wavelength L4, wave W5 has a wavelength L5, wave W6 has a wavelength L6, and wave W7 has a wavelength L7. The wavelengths increase in magnitude in order from the medial extremity 30 to the lateral extremity 32, with wavelength L2 greater than wavelength L1, wavelength L3 greater than wavelength L2, wavelength L4 greater than wavelength L3, wavelength L5 greater than wavelength L4, wavelength L6 greater than wavelength L5, and wavelength L7 greater than wavelength L6. The wavelength of partial wave W8 is not shown as the sole plate 10 does not include the entire length of the wave W8, but a full wavelength of wave W8 would be greater than wavelength L7.

Generally, the compressive stiffness of the sole plate 10 under dynamic loading increases as wavelength decreases, as amplitude of the crests increases, and as depth of the troughs increases. Accordingly, the portion of the sole plate 10 between the longitudinal midline 28 and the medial extremity 30 has a greater compressive stiffness than the portion of the sole plate 10 between the longitudinal midline 28 and the lateral extremity 32. More specifically, the sole plate 10 increases in compressive stiffness from the medial extremity 30 to the lateral extremity 32 at the location of the transverse cross-section of FIG. 3. This corresponds with dynamic compressive loading during expected activities, as loads at the medial side of the forefoot region 18 are higher than loads at the lateral side of the forefoot region 18.

Compressive stiffness under dynamic loading corresponds with the thickness of the sole plate 10 between the top surface 24 and the bottom surface 26, with a thicker sole plate 10 causing a greater compressive stiffness. The sole plate 10 is configured with a constant thickness T over its entire expanse, as is evident in FIGS. 3 and 4. The compressive stiffness of the sole plate 10 can thus be tuned by selecting the wave lengths, the amplitudes of the crests, the depths of the troughs, and the thickness of the plate 10, and any variations of these at various regions of the sole plate 10.

Figure 4:
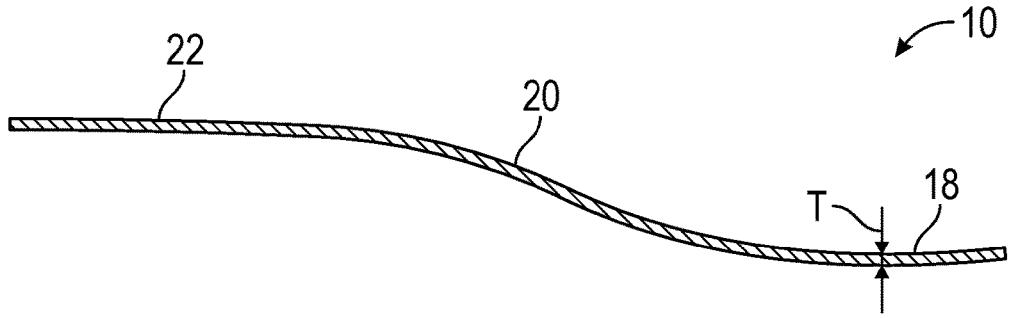
FIG. 4 is a schematic cross-sectional illustration of the sole plate of FIG. 1 taken at lines 4-4 in FIG. 1.
Figure 5:
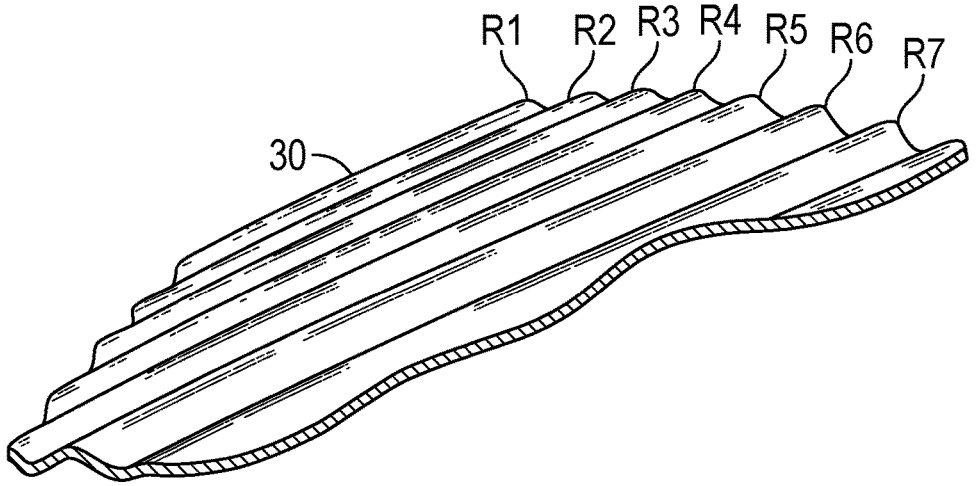
FIG. 5 is a schematic fragmentary perspective illustration of the sole plate of FIG. 1.

As is also apparent in FIG. 4, the sole plate 10 slopes downward in the midfoot region 20 from the heel region 22 to the forefoot region 18, creating a flattened S-shape. The forefoot region 18 may extend upward at a foremost extent, such that the forefoot region is concave at the foot-facing surface and the sole plate 10 has a spoon shape. The midsole 40 in which the sole plate 10 is embedded may slope in a like manner, to form a footbed shape at its top surface 60 shown in FIG. 6. The slope of the sole plate 10 also helps to lessen the bending stiffness of the sole plate 10 at the metatarsal phalangeal joints of the foot 42 (i.e., for bending in the longitudinal direction), as the sole plate 10 has some precurvature under these joints.

Figure 7:
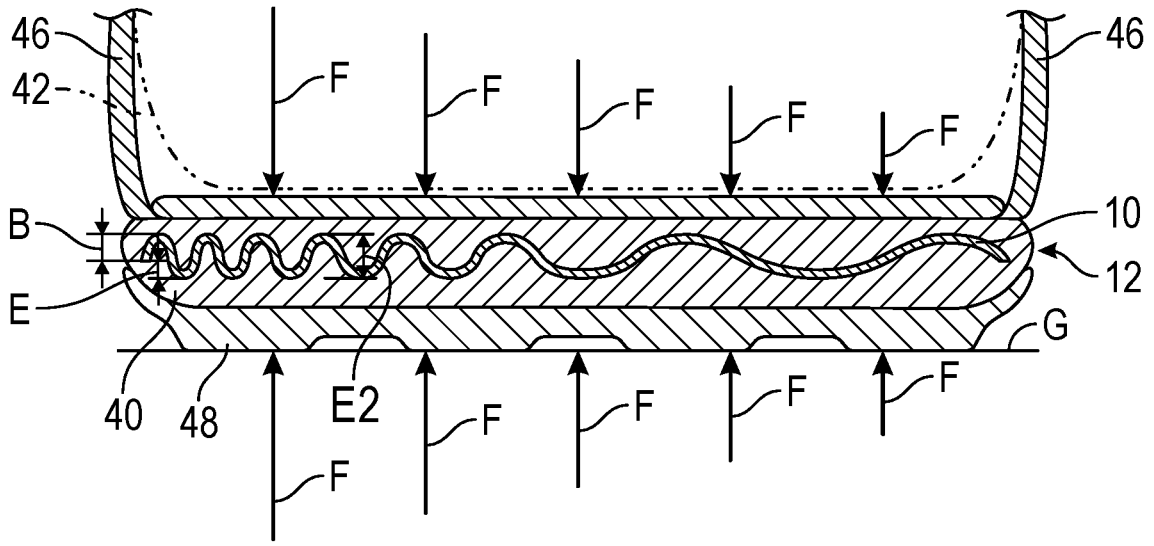
FIG. 7 is a schematic cross-sectional illustration of the article of footwear of FIG. 6 with the sole structure under dynamic compressive loading.

FIG. 6 shows the steady state compressive loading of the sole plate 10, and FIG. 7 shows the sole plate 10 under dynamic compressive loading, represented by vertically downward forces F of the foot 42 on the sole structure 12 (normal to the crests and troughs) and vertically upward forces F on the sole structure 12 (normal to the crests and troughs) due to the reaction force of the ground G. The dynamic compressive forces F may be, for example, loading of the forefoot portion 18 during running. The forces F are greater on the waves between the medial edge 30 and the longitudinal midline 28 than between the lateral edge 32 and the longitudinal midline 28. However, the shorter wavelengths of the waves nearest the medial edge 30 increase the compressive stiffness of the sole plate 10 in this region so that the change in elevation (flattening) of the sole plate 10 during dynamic compressive loading is substantially uniform in the different regions despite the different magnitudes of the compressive load, as described.

Although represented at the forefoot region 18 in FIGS. 6 and 7, dynamic compressive loading of the sole plate 10 and resilient return of the sole plate 10 to its elevation under steady state loading also occurs at the heel region 22 and the midfoot region 20. As depicted in FIG. 7, the sole plate 10 flattens somewhat under the compressive loading, in correspondence with the magnitude of the loading. The amplitudes decrease from amplitude A under steady state loading, to amplitude B under compressive loading. The depths of the troughs likewise decrease from depth D under steady state loading to depth E under compressive loading. The elevation of the sole plate 10 at each wave, which is the magnitude from the depth of the trough of a wave to the crest of the wave (i.e., the sum of the depth of the trough and the amplitude of the crest), thus decreases under compressive loading from elevation E1 in FIG. 6 to elevation E2 in FIG. 7. The transverse width of the sole plate 10 and of the midsole 40 may increase under compressive loading as the crests and troughs flatten. Due to the resiliency of the sole plate 10, the amplitude of the crests and the depths of the troughs return to their steady state magnitudes A and D, respectively, when the dynamic compressive load is removed and the waves of the sole plate return to their steady state elevation.

FIGS. 8-11 show another embodiment of a sole plate 110 alike in all aspects to sole plate 10 except that sole plate 110 has transverse waves of equal wavelength from the medial edge 30 to the lateral edge 32. The resiliency of the sole plate 110 contributes to a desirably high percentage energy return of a sole structure 112 shown in FIGS. 12-13. The sole plate 110 is a unitary, one-piece component that includes a forefoot region 18, a midfoot region 20, and a heel region 22. In other embodiments, within the scope of the present teachings, a sole plate with top and bottom surfaces and transverse waves similar to those of sole plate 110 may include only two contiguous ones of these regions, such as a midfoot region and at least one of a forefoot region and a heel region.

The sole plate 110 has a corrugated top surface 124 and a complementary corrugated bottom surface 126. The bottom surface 126 is considered complementary to the top surface 124 because the surfaces 124, 126 are such that the sole plate 110 has an undulating profile P2 at a transverse cross-section taken anywhere through the sole plate 110 perpendicular to a longitudinal midline 128 of the sole plate 110. For example, at the transverse cross-section shown in FIG. 10, the undulating profile P2 includes multiple waves: wave W10, wave W20, wave W30, wave W40, wave W50, wave W60, wave W70, wave W80, wave W90, wave W100, and wave W110. Wave W10 begins at the medial edge 30 of the sole plate 110, and wave W110 ends at the lateral edge 32 of the sole plate 110. Although the waves are shown as periodic, rounded waves, each generally following the shape of a sine wave, the waves could be squared or angular.

Figure 8:
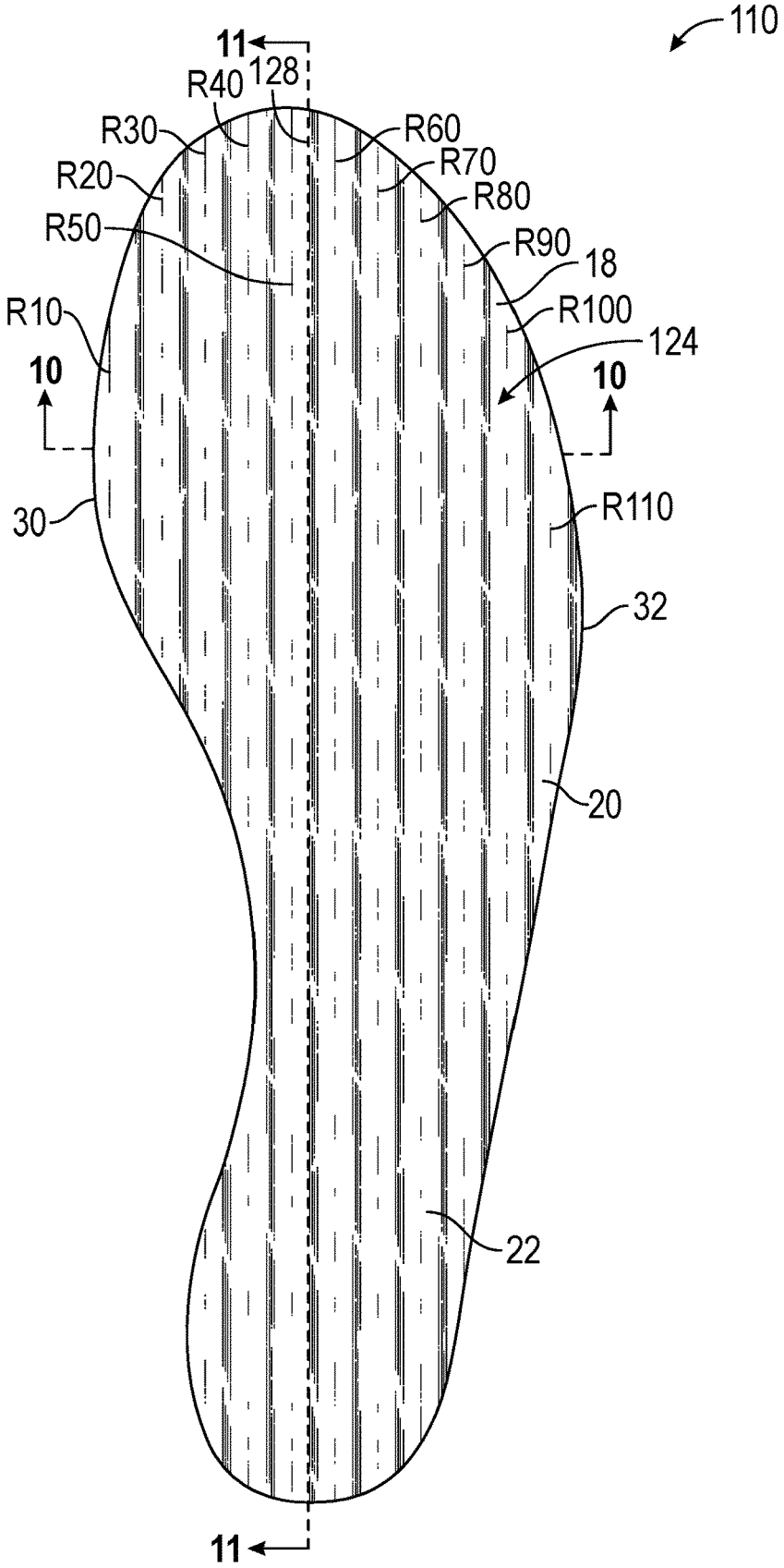
FIG. 8 is a schematic top view of another embodiment of a sole plate for an article of footwear in accordance with an alternative aspect of the present teachings
Figure 9:
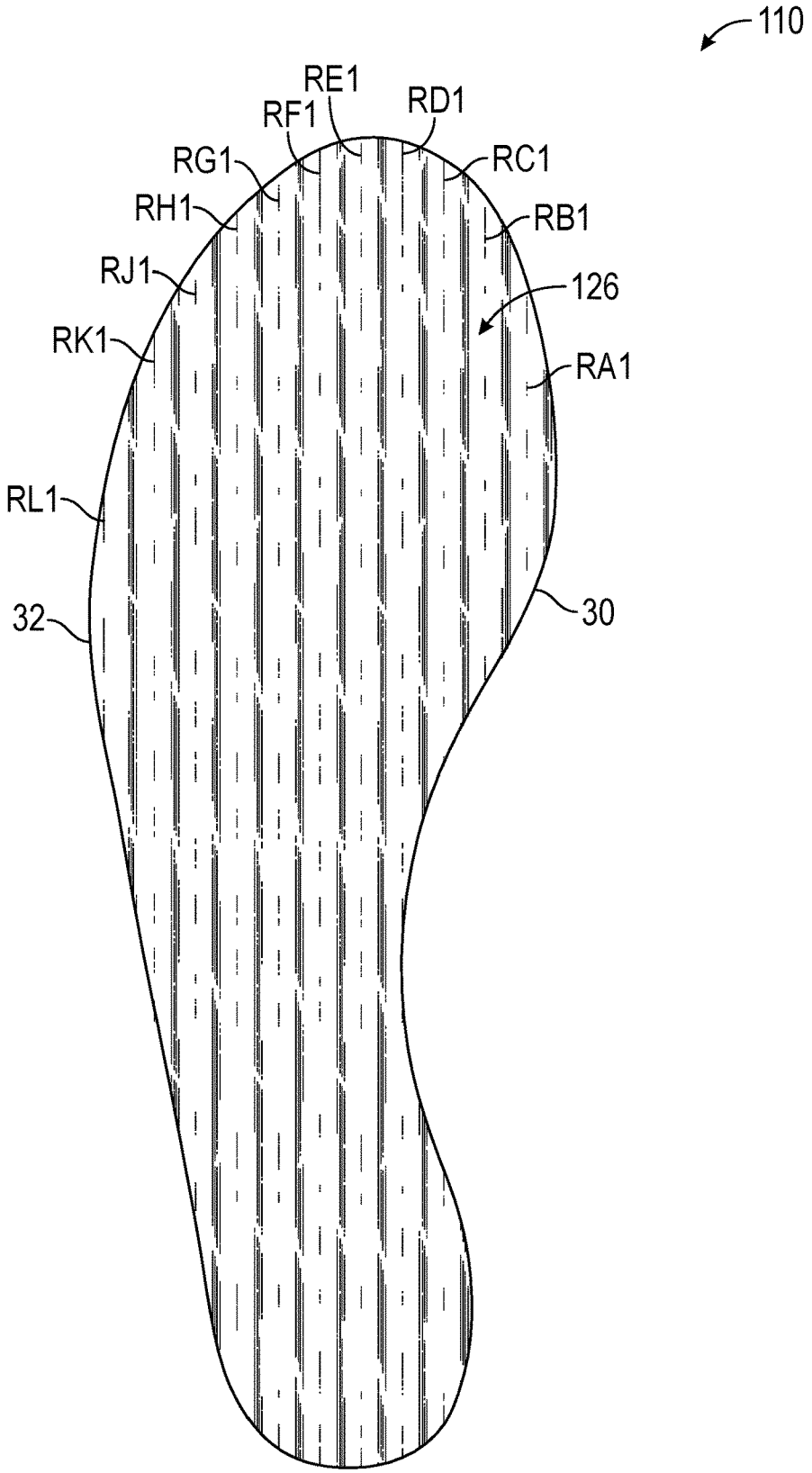
FIG. 9 is a schematic bottom view of the sole plate of FIG. 8.

Each wave W10-W110 has a crest and a trough. For example, wave W10 has a crest C10 and a trough T10. Wave W20 has a crest C20 and a trough T20. Wave W30 has a crest C30 and a trough T30. Wave W40 has a crest C40 and a trough T40. Wave W50 has a crest C50 and a trough T50. Wave W60 has a crest C60 and a trough T60. Wave W70 has a crest C70 and a trough T70. Wave W80 has a crest C80 and a trough T80. Wave W90 has a crest C90 and a trough T90. Wave W100 has a crest C100 and a trough T100. Wave W110 has a crest C110 and a trough T110. The crests C10-C110 are at the top surface 124, and the troughs T10-T110 are at the bottom surface 126. Because the waves extend longitudinally, the crests form ridges R10, R20, R30, R40, R50, R60, R70, R80, R90, R100, and R110 at the top surface 124 as shown in FIG. 8. The ridges R10, R20, R30, R40, R50, R60, R70, R80, R90, R100, and R110 correspond with the crests C10, C20, C30, C40, C50, C60, C70, C80, C90, C100, and C110, respectively. Because the waves extend longitudinally, the troughs forming ridges RA1, RB1, RC1, RD1, RE1, RF1, RG1, RH1, RJ1, RK1, and RL1 at the bottom surface 126 (as shown in FIG. 9) correspond with troughs T10, T20, T30, T40, T50, T60, T70, T80, T90, T100, and T110, respectively. The ridges R10, R20, R30, R40, R50, R60, R70, R80, R90, R100, and R110 at the top surface 124, and the ridges RA1, RB1, RC1, RD1, RE1, RF1, RG1, RH1, RJ1, RK1, RL1 at the bottom surface 126 extend longitudinally and parallel to one another and to the longitudinal midline 128 in the forefoot region 18, the midfoot region 20, and the heel region 22. Depending on the shape of the outer perimeter of the sole plate 110 at the medial edge 30 and the lateral edge 32, individual ones of the ridges may extend in only one or two of the forefoot region, the midfoot region, or the heel region. For example, ridges R10 and RA1 extend only on the forefoot region 18 due to the curvature of the medial edge 30. As a group, however, the ridges extend the entire length of the sole plate 110.

Figure 12:
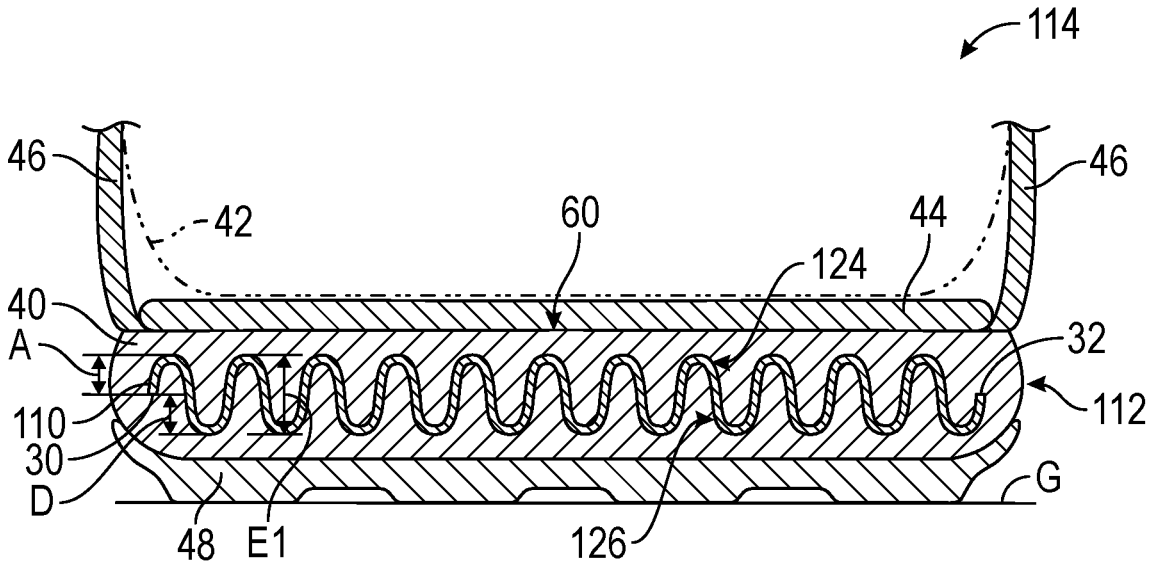
FIG. 12 is a schematic transverse cross-sectional illustration of an article of footwear including a sole structure with the sole plate of FIG. 8 embedded in a midsole.

As shown in FIG. 12, the sole plate 110 can be embedded in a foam midsole 40 of the sole structure 112. The top surface 124, bottom surface 126, and the periphery, including both the medial edge 30 and the lateral edge 32 are encapsulated by the foam midsole 40. In the embodiment shown, the foam midsole 40 overlays and is in contact with the entire top surface 124, and underlies and is in contact with the entire bottom surface 126.

Figure 10:
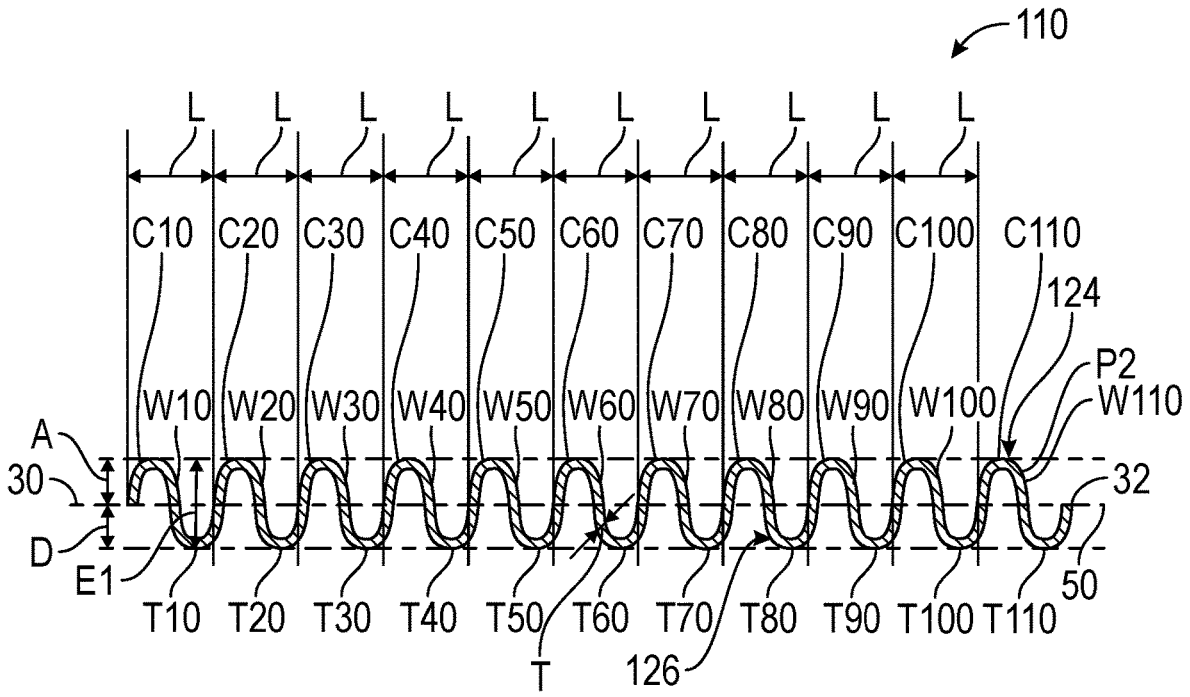
FIG. 10 is a schematic cross-sectional illustration of the sole plate of FIG. 8 taken at lines 10-10 in FIG. 8.

The sole plate 110 is a resilient material such as a fiber strand-lain composite, a carbon-fiber composite, a thermoplastic elastomer, a glass-reinforced nylon, wood, or steel. The resiliency of the sole plate 110 is such that when a dynamic compressive load is applied with at least a component of the force normal to the crests and the troughs (i.e., downward on the crests and with a reaction force upward on the troughs), the transverse waves will decrease in elevation from a steady state elevation to a loaded elevation, and will return to the steady state elevation upon removal of the dynamic compressive load. More specifically, as shown in FIGS. 10 and 12, each of the waves has a steady state elevation E1. The steady state elevation exists when the sole plate 110 is under a steady state load, or is unloaded. A steady state load is a load that remains constant, such as when a wearer of the article of footwear 114 is standing relatively still.

Referring again to FIG. 10, each of the multiple waves has an amplitude at its crest, and a depth at its trough. In the sole plate 110, each of the crests C10, C20, C30, C40, C50, C60, C70, C80, C90, C100, and C110 has an equal amplitude A. Additionally, each of the troughs T10, T20, T30, T40, T50, T60, T70, T80, T90, T100, and T110 has an equal depth D. In the embodiment shown, the amplitude A is equal to the depth D. The amplitude A of each crest is measured from a center axis 50 (i.e., the horizontal axis) of the sole plate 110 at the transverse cross section to the crest at the top surface 124. The depth D of each trough is measured from the center axis 50 of the sole plate 110 at the transverse cross section to the trough at the bottom surface 126.

In other embodiments, the amplitudes of the waves could vary, the depths of the waves could vary, or both could vary. For example, in one embodiment, the amplitudes of the crests could progressively decrease from the medial edge 30 to the lateral edge 32, and the depths of the troughs could progressively decrease from the medial edge 30 to the lateral edge 32.

In contrast to the sole plate 10, each of the waves W10, W20, W30, W40, W50, W60, W70, W80, W90, W100, and W110 are of an equal wavelength L. The sole plate 110 is configured with a constant thickness T over its entire expanse, as is evident in FIGS. 10 and 11. The compressive stiffness of the sole plate 110 can thus be tuned by selecting the wave lengths, the amplitudes of the crests, the depths of the troughs, and the thickness of the plate 110, and any variations of these at various regions of the sole plate 110.

Figure 11:
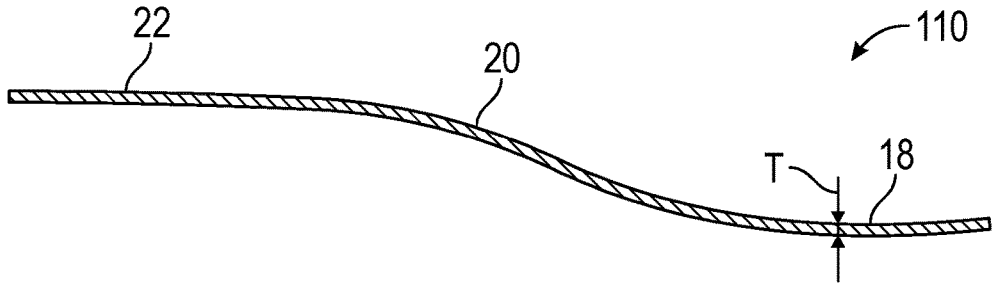
FIG. 11 is a schematic cross-sectional illustration of the sole plate of FIG. 8 taken at lines 11-11 in FIG. 8.

As is also apparent in FIG. 11, the sole plate 110 slopes downward in the midfoot region 20 from the heel region 22 to the forefoot region 18. The midsole 40 in which the sole plate 110 is embedded may slope in a like manner, to form a footbed shape at its top surface 60 shown in FIG. 12. The slope of the sole plate 110 also helps to lessen the bending stiffness of the sole plate 110 at the metatarsal phalangeal joints of the foot 42 (i.e., for bending in the longitudinal direction), as the sole plate 110 has some pre-curvature under these joints.

Figure 13:
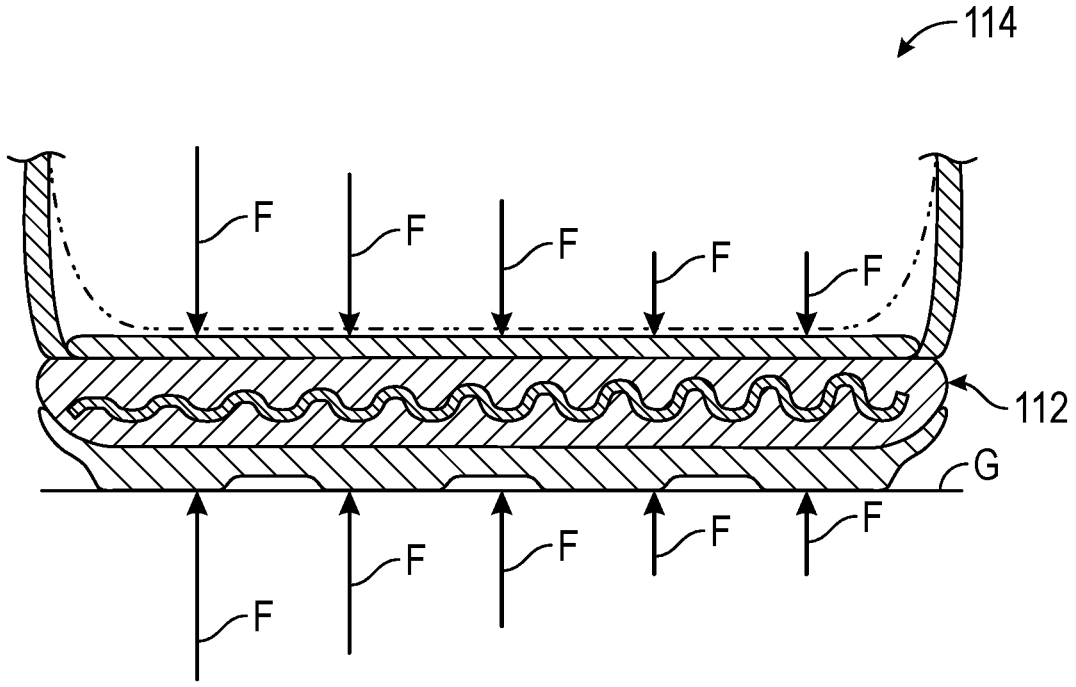
FIG. 13 is a schematic cross-sectional illustration of the article of footwear of FIG. 12 with the sole structure under dynamic compressive loading.
Figure 14:
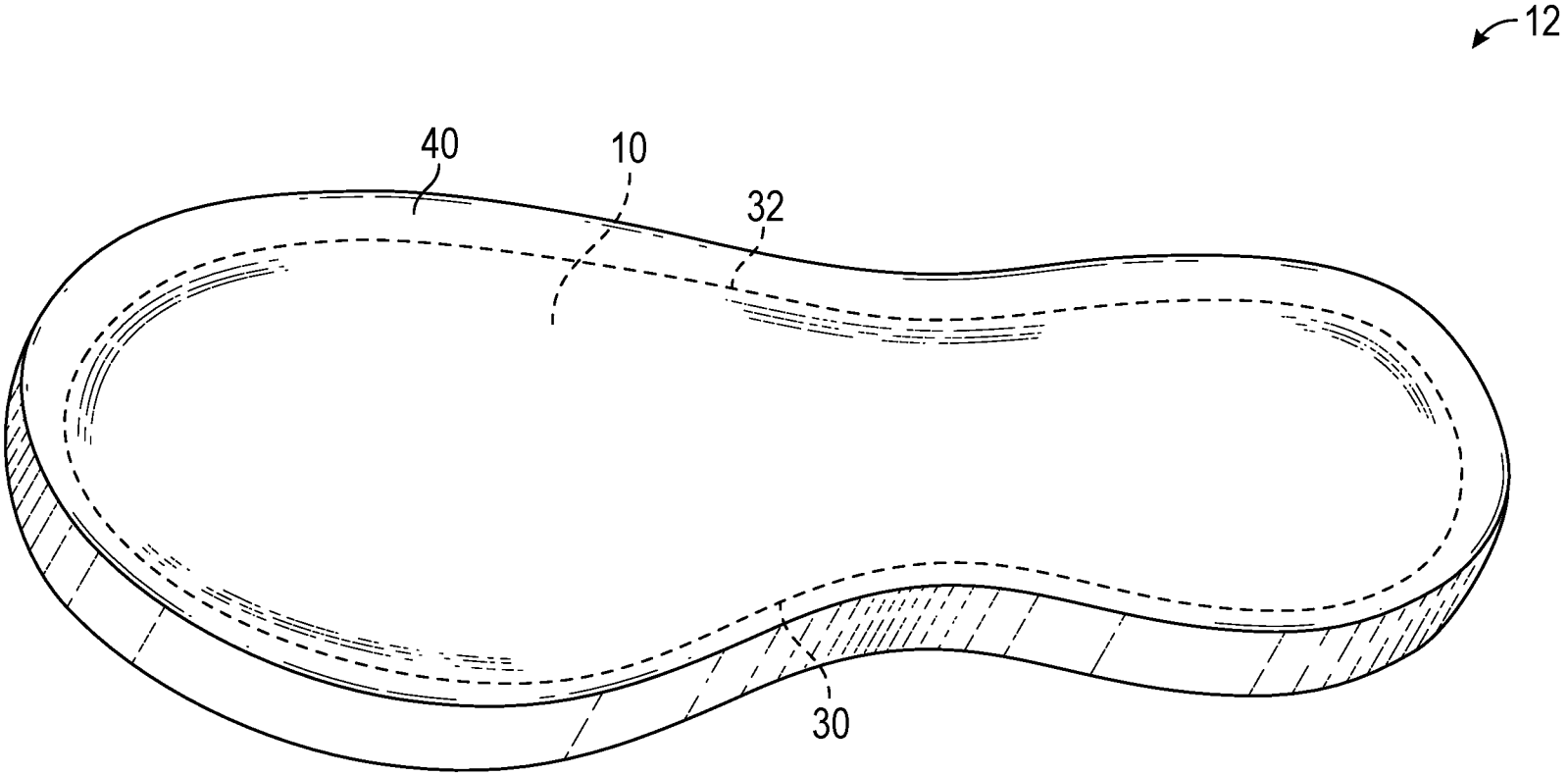
FIG. 14 is a schematic perspective illustration of the midsole of FIG. 6 with the sole plate of FIG. 1 indicated in hidden lines embedded in the midsole.

FIG. 12 shows the steady state compressive loading of the sole plate 110, and FIG. 13 shows the sole plate 110 under dynamic compressive loading, represented by vertically downward forces F of the foot 42 on the sole structure 112 (normal to the crests and troughs) and vertically upward forces F on the sole structure 112 (normal to the crests and troughs) due to the reaction force of the ground G. The forces F are greater on the waves between the medial edge 30 and the longitudinal midline 28 than between the lateral edge 32 and the longitudinal midline 28. The dynamic compressive load indicated by arrows F may be, for example, loading of the forefoot portion 18 during running. Although represented at the forefoot region 18 in FIGS. 12 and 13, dynamic compressive loading of the sole plate 110 and resilient return to the steady state loading also occurs at the heel region 22 and the midfoot region 20.

As depicted in FIG. 13, the sole plate 110 flattens somewhat under the compressive loading, in correspondence with the magnitude of the loading. Because the wavelength L of each of the waves W10-W110 is constant in the sole plate 110, and does not vary in correspondence with the dynamic loading as does the sole plate 10, the amplitudes of those waves that bear greater dynamic compressive loads decrease more than those that bear lesser loads. The amplitude of the waves thus decrease from amplitude A under steady state loading shown in FIG. 12, to various smaller amplitudes under dynamic compressive loading shown in FIG. 13. The depths of the troughs likewise decrease from depth D under steady state loading to various smaller depths under dynamic compressive loading. The elevation of the sole plate 110 thus decreases under compressive loading from elevation E1 in FIG. 12 to various smaller elevations in FIG. 13. The transverse width of the sole plate 110 and of the midsole 40 may increase under compressive loading as the crests and troughs flatten. Due to the resiliency of the sole plate 110, the amplitude of the crests and the depths of the troughs return to their steady state magnitudes A and D, respectively, when the dynamic compressive load is removed. The elevation of the sole plate 110 at each wave thus also returns to its steady state elevation.

Figures 15, 16, 17, 18:
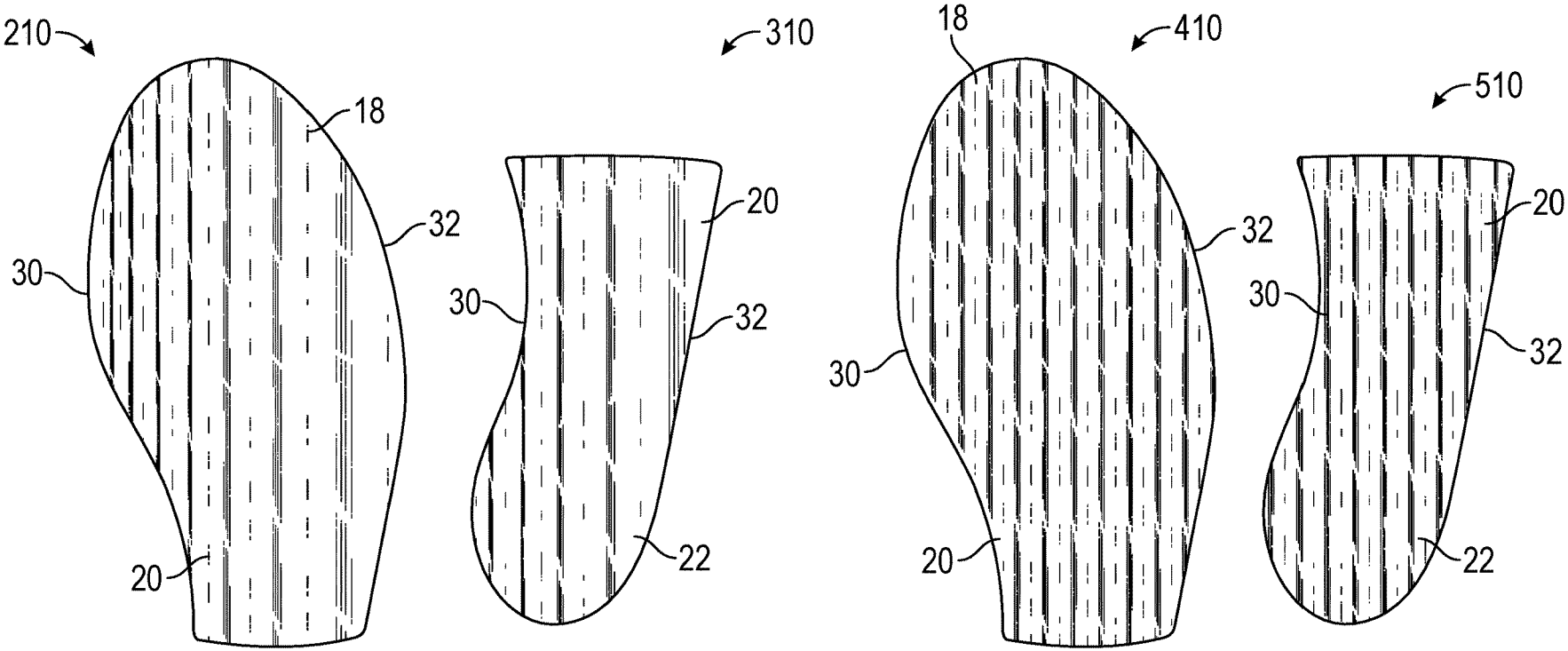
FIG. 15 is a schematic top view of another alternative embodiment of a sole plate for an article of footwear.
FIG. 16 is a schematic top view of another alternative embodiment of a sole plate for an article of footwear.
FIG. 17 is a schematic top view of another alternative embodiment of a sole plate for an article of footwear.
FIG. 18 is a schematic top view of another alternative embodiment of a sole plate for an article of footwear.

Although sole plates 10 and 110 are full-length sole plates as they each have a forefoot region 18, a midfoot region 20, and a heel region 22, other sole plates within the scope of the present teachings may have only two contiguous ones of these regions. For example, sole plate 210 in FIG. 15 has only a forefoot region 18 and a midfoot region 20, and sole plate 310 in FIG. 16 has only a midfoot region 20 and a heel region 22. Sole plates 210 and 310 have transverse waves arranged as in sole plate 10, with wavelengths that increase from a medial edge 30 to a lateral edge 32. Similarly, sole plate 410 of FIG. 17 has only a forefoot region 18 and a midfoot region 20, and sole plate 510 in FIG. 18 has only a midfoot region 20 and a heel region 22. Sole plates 410 and 510 have transverse waves arranged as in sole plate 110, with wavelengths that are constant from a medial edge 30 to a lateral edge 32.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear" or "footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. As used in the description and the accompanying claims, unless stated otherwise, a value is considered to be "approximately" equal to a stated value if it is neither more than 5 percent greater than nor more than 5 percent less than the stated value. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of an article of footwear extends between a forefoot region and a heel region of the article of footwear. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of an article of footwear extends between a lateral side and a medial side of the article of footwear. The transverse direction or axis may also be referred to as a lateral direction or axis or a mediolateral direction or axis.

The term "vertical" refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to individual components of a sole structure. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the article of footwear is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the article of footwear in an assembled article of footwear. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

The invention claimed is:

1. A sole structure for an article of footwear comprising:

a sole plate including a midfoot region and at least one of a forefoot region and a heel region;

wherein the sole plate has an undulating profile at a transverse cross-section of the sole plate, the undulating profile including multiple waves each having a crest and a trough, and the sole plate has ridges corresponding with the crest and the trough of each wave and extending longitudinally throughout the midfoot region and the at least one of a forefoot region and a heel region; and wherein the multiple waves vary in at least one of amplitude or depth.

2. The sole structure of claim 1, wherein the sole plate is a resilient material such that each of the multiple waves decreases in elevation from a steady state elevation to a loaded elevation under a dynamic compressive load, and returns to the steady state elevation upon removal of the dynamic compressive load.

3. The sole structure of claim 2, wherein the sole plate is one of a fiber strand-lain composite, a carbon-fiber composite, a thermoplastic elastomer, a glass-reinforced nylon, wood, or steel.

4. The sole structure of claim 1, wherein the undulating profile extends from a medial extremity of the sole plate to a lateral extremity of the sole plate.

5. The sole structure of claim 1, wherein the multiple waves vary in wavelength.

6. The sole structure of claim 1, wherein:

the multiple waves include at least two waves disposed between a longitudinal midline and a medial extremity of the sole plate, and at least two waves disposed between the longitudinal midline and a lateral extremity of the sole plate; and the at least two waves disposed between the longitudinal midline and the medial extremity have a shorter average wavelength than the at least two waves disposed between the longitudinal midline and the lateral extremity.

7. The sole structure of claim 1, wherein the ridges extend parallel to one another and to a longitudinal midline of the sole plate in the midfoot region and in the at least one of the forefoot region and the heel region.

8. The sole structure of claim 1, wherein:

the sole plate includes both the forefoot region and the heel region; and the sole plate slopes downward in the midfoot region from the heel region to the forefoot region.

9. The sole structure of claim 1, further comprising:

a foam midsole; and wherein the sole plate is embedded in the foam midsole, with both a medial edge of the sole plate and a lateral edge of the sole plate encapsulated by the foam midsole.

10. The sole structure of claim 1, wherein the sole plate includes both the forefoot region and the heel region, and is a unitary, one-piece component.

11. The sole structure of claim 1, wherein wavelengths of all of the multiple waves increase in magnitude in order in a direction from a medial edge of the sole plate to a lateral edge of the sole plate.

12. The sole structure of claim 1, wherein at least some of the ridges extend an entire length of the sole plate.

13. The sole structure of claim 1, wherein the sole plate includes the forefoot region, and the sole plate extends upward at a foremost extent of the sole plate such that the forefoot region is concave at a foot-facing surface of the sole plate.

14. The sole structure of claim 1, wherein the sole plate varies in thickness.

15. The sole structure of claim 1, wherein the multiple waves are rounded, square, or angular.

16. The sole structure of claim 1, wherein:

the sole plate includes both the forefoot region and the heel region; and a medial edge of the sole plate is contoured so that at least one of the ridges has a first portion that extends in the forefoot region of the sole plate and terminates at the medial edge of the sole plate, and has a second portion that extends only in the heel region of the sole plate and terminates at the medial edge of the sole plate.

17. A sole structure for an article of footwear comprising:

a sole plate including a midfoot region and a forefoot region;

a foam midsole;

wherein the sole plate is embedded in the foam midsole;

wherein the sole plate extends upward at a foremost extent of the sole plate such that the forefoot region is concave at a foot-facing surface of the sole plate;

wherein the sole plate has an undulating profile at a transverse cross-section of the sole plate, the undulating profile including multiple waves each having a crest and a trough, and the sole plate has ridges corresponding with the crest and the trough of each wave and extending longitudinally throughout the midfoot region and the forefoot region; and wherein the multiple waves vary in at least one of amplitude or depth.

18. The sole structure of claim 17, wherein:

the multiple waves include at least two waves disposed between a longitudinal midline and a medial extremity of the sole plate, and at least two waves disposed between the longitudinal midline and a lateral extremity of the sole plate; and the at least two waves disposed between the longitudinal midline and the medial extremity have a shorter average wavelength than the at least two waves disposed between the longitudinal midline and the lateral extremity.

19. The sole structure of claim 17, wherein the sole plate further includes a heel region, and is a unitary, one-piece component.

20. The sole structure of claim 17, wherein:

the undulating profile extends from a medial extremity of the sole plate to a lateral extremity of the sole plate; and the multiple waves vary in wavelength.

* * * * *